United States Patent [19]

Stielow

[11] Patent Number: 4,928,559

[45] Date of Patent: May 29, 1990

[54] RATCHET WRENCH

[76] Inventor: Erwin H. Stielow, 1164 Glenn St., Philadelphia, Pa. 19115

[21] Appl. No.: 118,542

[22] Filed: Nov. 9, 1987

[51] Int. Cl.[5] ..... B25B 13/46

[52] U.S. Cl. ..... 81/63; 81/58.2; 81/124.2

[58] Field of Search ..... 81/60–63.2, 81/124.2, 124.3, 58.2, 180.1, 185.1, 185.2

[56] References Cited

U.S. PATENT DOCUMENTS

| | | | |
|---|---|---|---|
| 895,712 | 8/1908 | Anderson | 81/62 |
| 1,646,350 | 10/1927 | De Hertelendy | 81/63 |
| 2,712,259 | 7/1955 | Cowell | 81/58.2 X |
| 4,475,420 | 10/1984 | Atkinson et al. | 81/63 X |
| 4,604,919 | 8/1986 | Rollo | 81/58.2 |
| 4,699,028 | 10/1987 | Bosque | 81/63 X |

*Primary Examiner*—D. S. Meislin

*Attorney, Agent, or Firm*—John F. A. Earley; John F. A. Earley, III; P. Michael Walker

[57] ABSTRACT

An offset ratchet wrench for loosening and tightening nuts connecting copper tubing to faucet connections comprises a wrench body portion having a circular hole extending through it, the wrench body portion having a passageway or gap portion between the circular hole and an outer front side portion of the wrench body portion, the wrench body portion having a recess in its top surface next to and in partial contact with the circular hole, a pawl mechanism mounted on the body portion inside the recess, a nut driver having a hole extending through the nut driver from its top to its bottom, the nut driver having an upper portion and lower portion, the hole through the nut driver in the nut driver upper portion having a hexagonal-shaped periphery for engaging the nut, the lower portion of the nut driver having a substantially circular outer periphery and having a row of teeth encircling its outer periphery that are engaged by the pawl when the lower portion of the nut driver rests inside the circular hole of the wrench body portion, the nut driver having a main portion and a detachable wedge portion mounted on the main portion, the nut driver having an opening extending from the top of the nut driver to the bottom of the nut driver created by detaching the nut driver wedge portion from the nut driver main portion, and a handle attached to the bottom surface of the wrench body portion. The wrench may be provided with a number of hex-nut sleeve inserts of different sizes that may be placed inside the hexagonal-shaped hole of the nut driver upper portion so that the wrench may accomodate various sizes of nuts.

3 Claims, 2 Drawing Sheets

RATCHET WRENCH

BACKGROUND OF THE INVENTION

1. Field of the Invention

This invention relates to wrenches, and more particularly to a basin ratchet wrench for loosening and tightening nuts connecting copper tubing to faucet connections.

2. Description of the Prior Art

With kitchen and bathroom sinks, it is common practice to hide the plumbing from view, that is, to hide the copper tubing and faucet connections, by placing cabinets around them.

Although this is pleasing to the eye, these cabinets create tight quarters for a plumber or handyman repairing or working on the plumbing for these sinks. For example, due to the close quarters in a cabinet, it may be difficult, if not impossible, to loosen or tighten a nut connecting the copper tubing to the faucet connections using an ordinary wrench.

Further, tightening or loosening a nut connecting the copper tubing to the faucet connections using an ordinary wrench often requires repeatedly repositioning the wrench onto the nut after each pull on the wrench, and this is difficult to do when the view of the nut is obstructed by the cabinet.

SUMMARY OF THE INVENTION

It is an object of this invention to provide a new offset ratchet wrench that facilitates loosening or tightening a nut connecting the copper tubing to the faucet connections of a sink, especially where the work space around the nut is limited and the view of the nut is obstructed.

These and other objects are accomplished by providing an offset ratchet wrench for loosening and tightening nuts connecting copper tubing to faucet connections that comprises a wrench body portion having a top surface and a bottom surface, the wrench body portion having a circular hole extending between the wrench body portion top surface and the wrench body portion bottom surface, the wrench body portion having a passageway or gap portion between the circular hole and an outer front side portion of the wrench body portion, the wrench body portion having a recess in its top surface next to and in partial contact with the circular hole, a pawl mounted on the wrench body portion inside the recess, pawl holding means for holding the pawl in position after the pawl has been set in the desired tightening or loosening position, a nut driver having a hole extending through the nut driver from its top to its bottom, the nut driver having an upper portion and a lower portion, the hole through the nut driver in the nut driver upper portion having a hexagonal-shaped periphery for engaging the nut, the lower portion of the nut driver having a substantially circular outer periphery and having a row of teeth encircling its outer periphery that are engaged by the pawl when the lower portion of the nut driver rests inside the circular hole of the wrench body portion, the nut driver having a main portion and a detachable wedge portion mounted on the main portion, the nut driver having an opening extending from the top of the nut driver to the bottom of the nut driver created by detaching the nut driver wedge portion from the nut driver main portion, and a handle attached to the bottom surface of the wrench body portion, whereby the nut driver may be placed onto the tubing by detaching the nut driver wedge portion from the nut driver main portion, placing the nut driver main portion onto the tubing, and reattaching the nut driver wedge portion to the nut driver main portion such that the nut driver surrounds the tubing, whereby the nut driver may then be slid into the hole in the wrench body portion after the wrench body portion has been inserted around the tubing so that the pawl engages the teeth encircling the lower portion of the nut driver, and whereby the wrench may then be moved such that the nut is positioned inside the hexagonal-shaped portion of the hole in the nut driver. The offset ratchet wrench is provided with a number of hex-nut sleeve inserts of different sizes that may be placed inside the hexagonal-shaped portion of the hole in the nut driver upper portion so that the wrench may accommodate various sizes of nuts.

DETAILED DESCRIPTION

Figure 1:
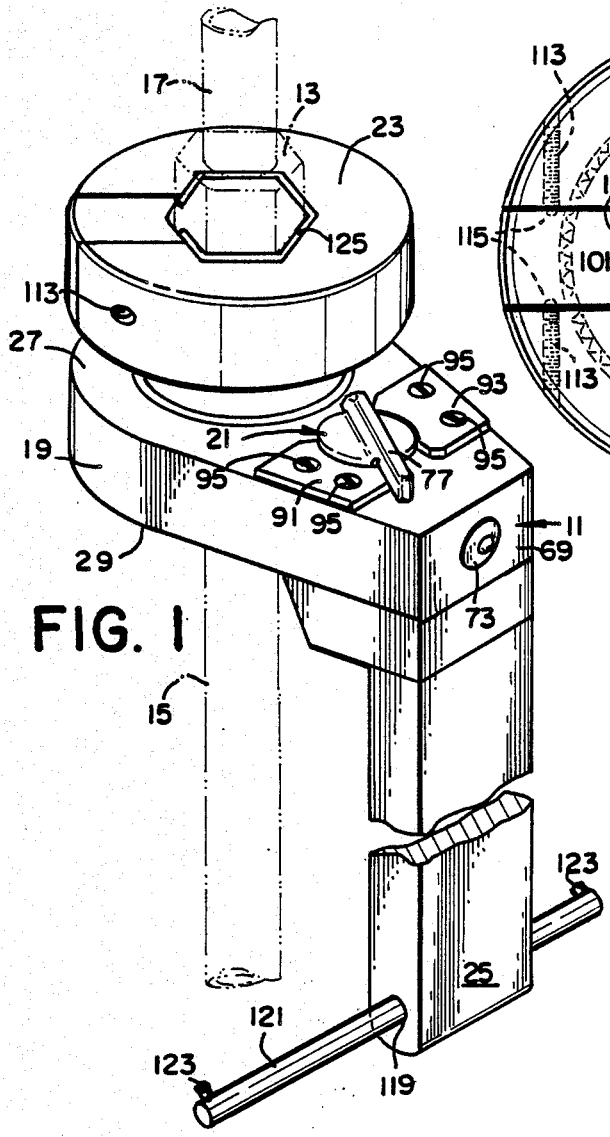
FIG. 1 is a perspective view of a ratchet wrench constructed in accordance with this invention.

Turning now to the drawings, there is shown an offset basin ratchet wrench 11 for loosening and tightening nuts 13 connecting copper tubing 15 to faucet connections 17, which comprises a wrench body portion 19, a pawl mechanism 21 mounted on wrench body portion 19, a nut driver 23 that engages wrench body portion 19, and a handle 25 attached to the wrench body portion 19.

Figure 5:
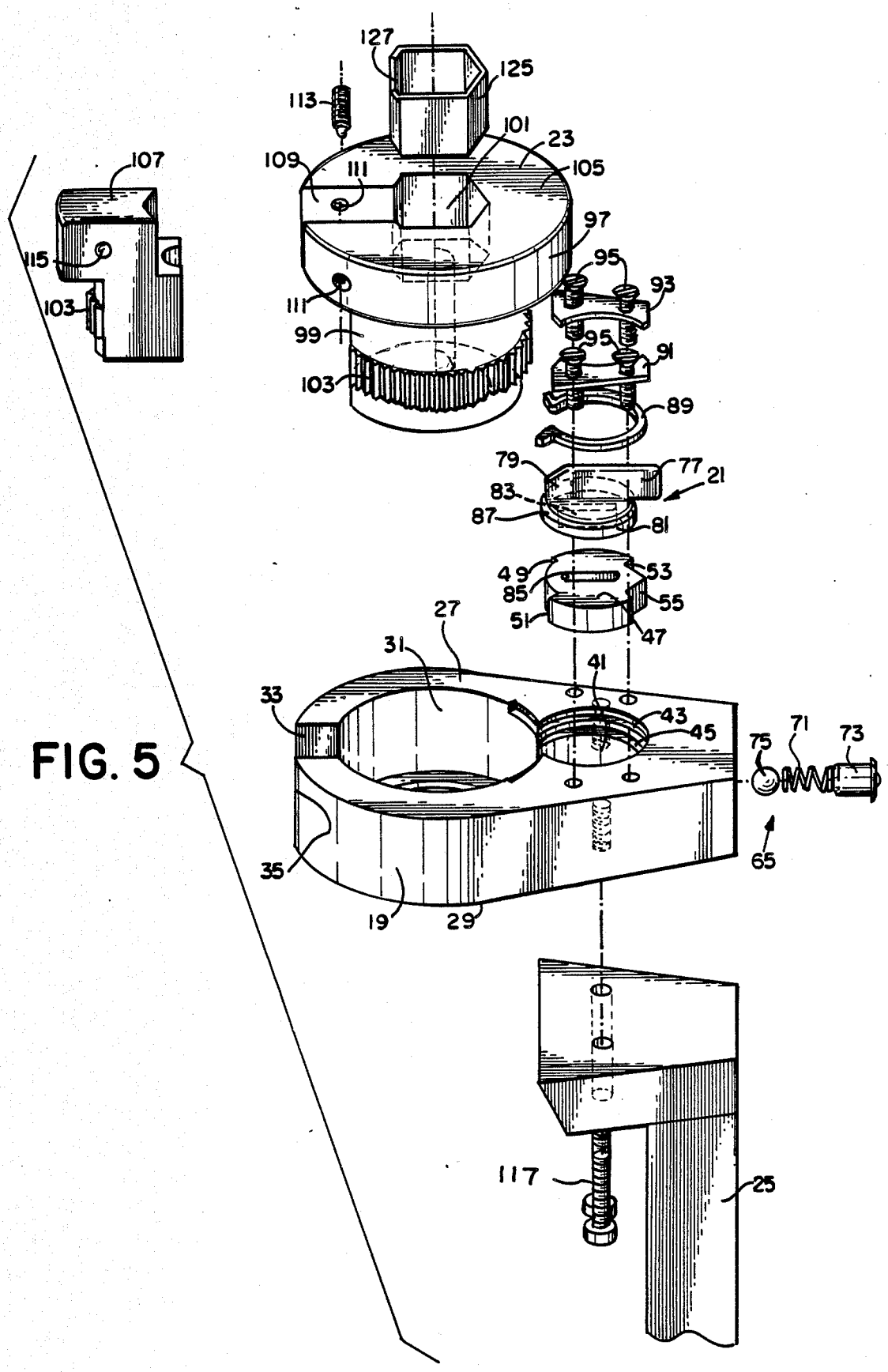
FIG. 5 is an exploded view of the invention.

The wrench body portion 19 has a top surface 27, a bottom surface 29, and a hole 31 extending completely through wrench body portion 19 from wrench body portion top surface 27 to wrench body portion bottom surface 29. Referring to FIG. 5, wrench body portion 19 also has a passageway or gap portion 33 between hole 31 and an outer front side portion 35 of wrench body portion 19 permitting the wrench body portion 19 to be placed around tubing 15 and nuts 13.

Figure 4:
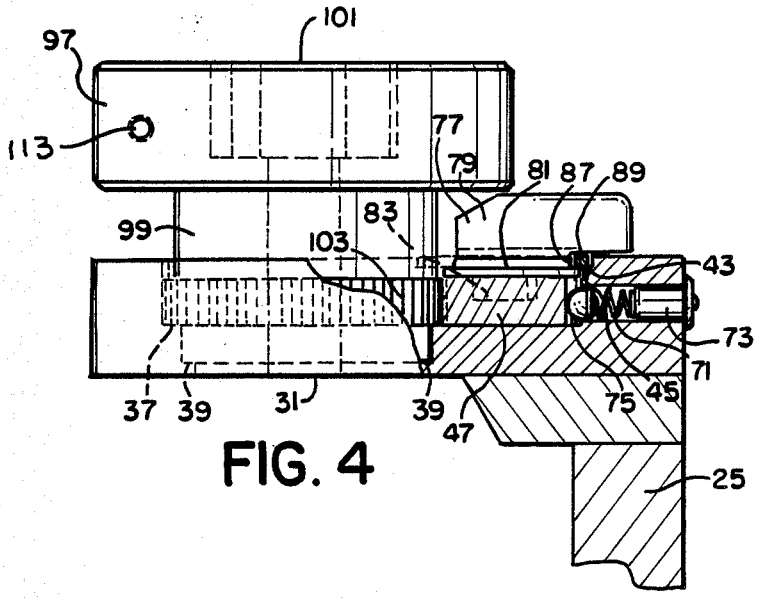
FIG. 4 is a partial view in section showing the nut driver mounted on the wrench body portion.

Wrench body portion 19, as shown in FIG. 4, is also provided with shelves 37 and 39 inside hole 31 around the periphery of hole 31.

Wrench body portion 19 has a recess 41 in its top surface 27 next to and in partial contact with hole 31, and recess 41 is provided with a pair of shelves 43 and 45 around its periphery.

Figure 2:
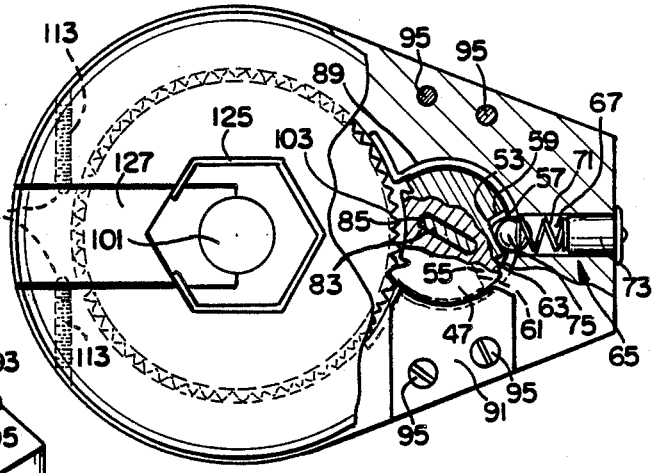
FIG. 2 is a partial view in section showing the pawl mechanism.
Figure 3:
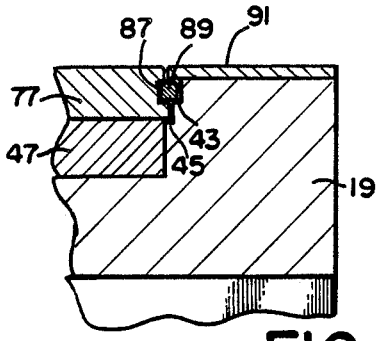
FIG. 3 is a partial view in section showing the pawl mechanism.

Pawl mechanism 21 includes a pawl 47 mounted on wrench body portion 19 inside recess 41. Pawl 47, as shown in FIGS. 2 and 5, is provided with a pair of ridges 49 and 51, and a pair of V-shaped grooves 53 and 55, groove 53 having a first face 57 and a second face 59 and groove 55 having a first face 61 and a second face 63.

A spring member 65 is mounted in a bore 67 that extends between recess 41 in the wrench body portion 19 and an outer rear side portion 69 of wrench body portion 19. Spring member 65 has a spring 71 that is attached to a plug or oil cup retainer 73 mounted in bore 67 at the outer rear side portion 69 of wrench body portion 19 and that is in contact with a retainer ball 75 at the other end of spring 71. Retainer ball 75 has a diameter that is substantially the same as the diameter of bore 67. Spring member 65 is positioned such that ball 75 partially protrudes from bore 67 into recess 41 and presses against pawl 47 to hold pawl 47 in the desired tightening or loosening position. Oil cup retainer 73 is provided with an oil cap so that oil, when necessary, may be added to oil cup retainer 73 at outer rear side portion 69.

A directional lever 77, which sits on shelf 43 in recess 41, is provided for positioning pawl 47 in the desired tightening or loosening position, and has an upper portion 79 and a lower portion 81. Directional lever 77 is provided with a tab 83 that is attached to the directional lever lower portion 81, and tab 83 rests inside a slot 85 in pawl 47.

Directional lever 77 has a groove 87 formed between directional lever upper and lower portions 79, 81 which encircles directional lever 77.

A horseshoe spring 89 sits partially on shelf 45 inside recess 41 with a portion of horseshoe spring 89 extending partially into groove 87 of directional lever 77. Plates 91 and 93 are attached to wrench body portion top surface 27 with screws 95 and overlap the portion of the horseshoe spring 89 not inside groove 87 of directional lever 77, thereby blocking the removal of horseshoe spring 89 from recess 41, which in turn holds directional lever 77 and pawl 47 inside recess 41.

Nut driver 23 has an upper portion 97 and a lower portion 99, and a hole 101 extends completely through nut driver 23 from the top of nut driver 23 to the bottom of nut driver 23. The hole 101 has a hexagonal-shaped periphery in nut driver upper portion 97 for engaging nuts, and a circular periphery in nut driver lower portion 99.

Nut driver lower portion 99 has a substantially circular outer periphery upon which is a row of teeth 103 that encircles the outer periphery of nut driver lower portion 99. Teeth 103 are engaged by pawl 47 when nut driver lower portion 99 is positioned inside hole 31 of wrench body portion 19.

Nut driver 23 includes a main portion 105 and a detachable wedge portion 107 that is mounted into the main portion 105. An opening or passageway 109 in the nut driver 23 extending from the top of the nut driver 23 to the bottom of the nut driver 23 is created by detaching nut driver wedge portion 107 from nut driver main portion 105. This passageway 109 is provided so that the nut driver 23 may be placed around the tubing 15.

Nut driver main portion 105 is provided with a pair of threaded bores 111, and a spring plunger 113, such as a STUBBY ® spring plunger, is mounted in each bore 111. Each spring plunger 113 has a threaded housing, and a ball and a spring inside the housing. The spring pushes the ball so that the ball partially protrudes from a swaged hole at the end of the housing. A pair of cup portions or depressions 115 is provided in the wedge portion 107 and each cup portion 115 is aligned with a corresponding spring plunger 113 such that the ball of the spring plunger 113 protrudes into the corresponding cup portion 115 to detachably hold wedge portion 107 to main portion 105.

Handle 25 is mounted on wrench body portion 19 with screws 117. Handle 25 is provided with a hole 119 in its lower end portion and with a torque bar 121 that is slidably mounted in hole 119. Torque bar 121 has a dimple 123 at each end to prevent torque bar 121 from sliding completely from the hole 119.

So that wrench 11 may accommodate various sizes of nuts, hex-nut sleeve inserts 125 are provided that may be placed inside the hexagonal-shaped portion of hole 101 in nut driver upper portion 97. Each sleeve insert 125 fits snugly inside the hexagonal-shaped portion of hole 101. Each sleeve insert 125 has the shape of a hexagonal-shaped hollow cylinder, and has a portion removed from its walls creating opening 127 to allow the sleeve insert 125 to be placed around tubing. The thickness of the cylinder walls of each sleeve insert 125 determines the size of the nut that the sleeve insert 125 is designed to accommodate. That is, a sleeve insert 125 having thinner walls is adapted to accommodate larger nuts while a sleeve insert 125 having thicker walls is adapted to accommodate smaller nuts.

In operation, nut driver 23 is placed around the tubing 15 by detaching the nut driver wedge portion 107 from the nut driver main portion 105 creating passageway 109 in nut driver 23. The nut driver main portion 105 is then placed around the tubing 15, and nut driver wedge portion 107 is reattached to nut driver main portion 105 such that nut driver 23 now surrounds tubing 15.

If the nut 13 that is desired to be tightened or loosened is smaller than the hexagonal-shaped portion of hole 101 of nut driver 23, the appropriately-sized sleeve insert 125 may be placed around the tubing 15 and slid down into the hexagonal-shaped portion of hole 101 in nut driver upper portion 97.

The wrench body portion 19 is inserted around the tubing 15 beneath nut driver 23, and nut driver 23 is slid into hole 31 in wrench body portion 19 with the bottom of nut driver 23 resting on shelf 39 of wrench body portion hole 31 and the bottom of the row of teeth 103 just clearing shelf 37 of wrench body portion hole 31.

Then, by turning directional lever 77 to the desired loosening or tightening position and by moving the wrench 11 so that the nut 13 that is desired to be tightened or loosened is positioned inside the hexagonal-shaped portion of hole 101 in the nut driver 23, the nut 13 may be turned by turning the handle 25, or if more torque is needed, by turning torque bar 121.

For example, nut 13 may be turned clockwise by pulling clockwise on wrench 11 when directional lever 77 is positioned so that ball 75 of spring member 65 pushes against face 63 of pawl groove 55 pushing pawl ridge 49 into contact with nut driver teeth 103. In this position, wrench body portion 19 is prevented from spinning clockwise independently of nut driver 23 since clockwise movement of wrench body portion 19 causes face 61 of pawl groove 55 to press ball 75 against the side wall of bore 67 blocking any further counterclockwise spinning of pawl 47 and causing ridge 49 of pawl 47 to block any clockwise movement of nut driver 23 independently of wrench body portion 19.

However, in this position, wrench body portion 19 is not prevented from spinning counterclockwise independently of nut driver 23 since such counterclockwise movement is not blocked by pawl 47. When wrench body portion 19 is spun counterclockwise, ridge 49 of pawl 47 may slip over nut driver teeth 103 since pawl 47 may be turned clockwise somewhat since pawl 47 may push ball 75 into bore 67.

By turning directional lever 77 so that ball 75 of spring member 65 pushes against face 57 of pawl groove 53 pushing pawl ridge 51 into contact with nut driver teeth 103, nut 13 may be turned counterclockwise by turning wrench 11 counterclockwise. In this position, wrench body 19 is prevented from spinning counterclockwise independently of nut driver 23 since counterclockwise movement of wrench body portion 19 causes face 59 of pawl groove 53 to press ball 75 against the side wall of bore 67 blocking any further clockwise spinning of pawl 47 and causing ridge 51 of pawl 47 to block any counterclockwise movement of nut driver 23 independently of wrench body portion 19.

However, in this position, wrench body portion 19 is not prevented from spinning clockwise independently of nut driver 23 since clockwise movement is not blocked by pawl 47. When wrench body portion 19 is spun clockwise, ridge 51 of pawl 47 may slip over nut driver teeth 103 since pawl 47 may be turned counterclockwise somewhat since pawl 47 may push ball 75 into bore 67.

Pawl 47, directional lever 77, and spring member 65 may be cleaned and replaced by compressing horseshoe spring 89 at its ends so that the portion of horseshoe spring 89 that surrounds directional lever 77 is pushed completely into groove 87 of directional lever 77 so that no portion of the horseshoe spring 89 remains in contact with the plates 91 and 93, thereby freeing pawl 47 and directional lever 77 from recess 41 in wrench body portion 19.

ADVANTAGES

Ratchet wrench 11 of the present invention may be used in close quarters, such as those found under a sink where it is difficult to loosen or tighten a nut connecting copper tubing to faucet connections.

When the view of a nut is obstructed, tightening or loosening the nut with ratchet wrench 11 does not require repeatedly repositioning ratchet wrench 11 onto the nut after each pull on ratchet wrench 11, which is an advantage over ordinary wrenches.

Ratchet wrench 11 may be provided with a number of hexnut sleeve inserts 125 of different sizes, that is, having different wall thicknesses, so that wrench 11 may accommodate various sizes of nuts. For example, by sizing the hexagonal-shaped portion of hole 101 to accommodate a particular standard nut size, and by providing wrench 11 with four differently sized sleeve nuts 125 adapted to accommodate four progressively smaller sizes of nuts, wrench 11 is adapted to accommodate five standard sizes of nuts, that is, wrench 11 becomes a five-in-one wrench.

I claim:

1. An offset basin ratchet wrench for loosening and tightening nuts connecting copper tubing to faucet connections comprising a wrench body portion having a top surface and a bottom surface, the wrench body portion having a circular hole extending between the wrench body portion top surface and the wrench body portion bottom surface, the wrench body portion having a passageway between the circular hole and an outer front side portion of the wrench body portion, the wrench body portion having a recess in its top surface next to and in partial contact with the circular hole, a pawl mounted on the wrench body portion inside the recess, pawl holding means for holding the pawl in position after the pawl has been set in a tightening position or a loosening position, a nut driver having a hole extending through the nut driver from its top to its bottom, the nut driver having an upper portion and a lower portion, the hole through the nut driver in the nut driver upper portion having a hexagonal-shaped periphery for engaging a nut connecting copper tubing to a faucet connection, the lower portion of the nut driver having a substantially circular outer periphery and having a row of teeth encircling its outer periphery that are engaged by the pawl when the lower portion of the nut driver rests inside the circular hole of the wrench body portion, the nut driver having a main portion and a detachable wedge portion mounted on the main portion, the nut driver having an opening extending from the top of the nut driver to the bottom of the nut driver created by detaching the nut driver wedge portion from the nut driver main portion, and a handle attached to the bottom surface of the wrench body portion, whereby the nut driver may be placed onto the tubing by detaching the nut driver wedge portion from the nut driver main portion, placing the nut driver main portion onto the tubing, and reattaching the nut driver wedge portion to the nut driver main portion such that the nut driver surrounds the tubing, whereby the nut driver may then be slid into the hole in the wrench body portion after the wrench body portion has been inserted around the tubing so that the pawl engages the teeth encircling the lower portion of the nut driver, and whereby the wrench may then be moved such that the nut is positioned inside the hexagonal-shaped portion of the hole in the nut driver, the nut driver detachable wedge portion being detachably secured to the nut driver main portion by a pair of spring members that are mounted in bores in the nut driver main portion that engage depressions in the side walls of the nut driver wedge portion, the spring members each having a spring that is in contact with a plug at one end and a ball at the other, whereby the spring causes the ball to partially protrude from each of the bores and to rest in a depression in the sidewall of the nut driver wedge portion holding the nut driver wedge portion in place, and whereby pulling outwardly on the nut driver wedge portion forces the balls into the bores so that the nut driver wedge portion may be removed.

2. An offset ratchet wrench for loosening and tightening nuts connecting copper tubing to faucet connections comprising a wrench body portion having a top surface and a bottom surface, the wrench body portion having a circular hole extending between the wrench body portion top surface and the wrench body portion bottom surface, the wrench body portion having a passageway between the circular hole and an outer front side portion of the wrench body portion, the wrench body portion having a recess in its top surface next to and in partial contact with the circular hole, a pawl mounted on the wrench body portion inside the recess, pawl holding means for holding the pawl in position after the pawl has been set in a tightening position or a loosening position, a nut driver having a hole extending through the nut driver from its top to its bottom, the nut driver having an upper portion and a lower portion, the hole through the nut driver in the nut driver upper portion having a hexagonal-shaped periphery for engaging a nut connecting copper tubing to a faucet connection, the hole through the nut driver in the nut driver lower portion having a circular periphery, the lower portion of the nut driver having a substantially circular outer periphery and having a row of teeth encircling its outer periphery that are engaged by the pawl when the lower portion of the nut driver rests inside the circular hole of the wrench body portion, the nut driver having a main portion and a detachable wedge portion mounted on the main portion, the nut driver having an opening extending from the top of the nut driver to the bottom of the nut driver created by detaching the nut driver wedge portion from the nut driver main portion, and a handle attached to the bottom surface of the wrench body portion, whereby the nut driver may be placed onto the tubing by detaching the nut driver wedge portion from the nut driver main portion, placing the nut driver main portion onto the tubing, and reattaching the nut driver wedge portion to the nut driver main portion such that the nut driver surrounds the tubing, whereby the nut driver may then be slid into the hole in the wrench body portion after the wrench body portion has been inserted around the tubing so that the pawl engages the teeth encircling the lower portion of the nut driver, and whereby the wrench may then be moved such that the nut is positioned inside the hexagonal-shaped portion of the hole in the nut driver, further including a hex-nut sleeve insert that may be placed inside the hexagonal-shaped hole of the upper portion of the nut driver so that the ratchet wrench may accommodate various sizes of nuts, the hex-nut sleeve insert having an opening in its side walls extending from the top of the sleeve insert to the bottom of the sleeve insert so that the sleeve insert may be placed around the tubing, the nut driver detachable wedge portion being detachably secured to the nut driver main portion by a pair of spring members that are mounted in bores in the nut driver main portion that engage depressions in the side walls of the nut driver wedge portion, the spring members each having a spring that is in contact with a plug at one end and a ball at the other, whereby the spring causes the ball to partially protrude from each of the bores and to rest in a depression in the sidewall of the nut driver wedge portion holding the nut driver wedge portion in place, and whereby pulling outwardly on the nut driver wedge portion forces the balls into the bores so that the nut driver wedge portion may be removed, the pawl holding means for holding the pawl in position after the pawl has been set in the desired tightening or loosening position being a spring member that is mounted in a bore that extends between the recess in the wrench body portion and an outer rear side portion of the wrench body portion, the spring member having a spring that is positioned against a plug mounted in the bore at the outer rear side portion of the wrench body portion and that is positioned against a ball at the other end of the spring, whereby the ball partially protrudes from the bore into the recess and presses against the pawl to hold the pawl in the desired tightening or loosening position, further including a directional lever for positioning the pawl in the desired tightening and loosening positions having an upper portion and a lower portion and being mounted on the pawl, the directional lever engaging the pawl with a tab that is attached to the lower portion of the directional lever and that rests inside an indentation in the pawl, the directional lever having a groove between its upper and lower portions which encircles the directional lever, the directional lever at the groove having a circumference that is circular, and further including, a horseshoe spring that rests partially on a shelf inside the recess in the wrench body portion, the horseshoe spring having a portion that extends partially into the groove in the directional lever, and a pair of plates being attached to the upper surface of the wrench body portion and overlapping the portion of the horseshoe spring not inside the groove in the directional lever, thereby blocking the removal of the horseshoe spring from the recess which in turn holds the directional lever and the pawl inside the recess of the wrench body portion, the handle having a hole in its lower end portion, and further including a torque bar slideably mounted in the hole, the torque bar having a dimple at each end to prevent the torque bar from sliding completely from the hole.

3. An offset basin ratchet wrench for loosening and tightening nuts connecting copper tubing to faucet connections comprising a wrench body portion having a top surface and a bottom surface, the wrench body portion having a circular hole extending between the wrench body portion top surface and the wrench body portion bottom surface, the wrench body portion having a passageway between the circular hole and an outer front side portion of the wrench body portion, the wrench body portion having a recess next to and in partial contact with the circular hole, a pawl mounted on the wrench body portion inside the recess, pawl holding means for holding the pawl in position after the pawl has been set in a tightening position or a loosening position, a nut driver having a hole extending through the nut driver from its top to its bottom, the nut driver having an upper portion and a lower portion, the hole through the nut driver in the nut driver upper portion having a hexagonal-shaped periphery for engaging a nut connecting copper tubing to a faucet connection, the lower portion of the nut driver having a substantially circular outer periphery and having a row of teeth encircling its outer periphery that are engaged by the pawl when the lower portion of the nut driver rests inside the circular hole of the wrench body portion, the nut driver having a main portion and a detachable wedge portion mounted on the main portion, the nut driver having an opening extending form the top of the nut driver to the bottom of the nut driver created by detaching the nut driver wedge portion from the nut driver main portion, and a handle attached to the bottom surface of the wrench body portion, whereby the nut driver may be placed onto the tubing by detaching the nut driver wedge portion from the nut driver main portion, placing the nut driver main portion onto the tubing, and reattaching the nut driver wedge portion to the nut driver main portion such that the nut driver surrounds the tubing, whereby the nut driver may then be slid into the hole in the wrench body portion after the wrench body portion has been inserted around the tubing so that the pawl engages the teeth encircling the lower portion of the nut driver, whereby the wrench may then be moved such that the nut is positioned inside the hexagonal-shaped portion of the hole in the nut driver, the pawl holding means for holding the pawl in position after the pawl has been set in the desired tightening or loosening position being a spring member that is mounted in a bore that extends between the recess in the wrench body portion and an outer rear side portion of the wrench body portion, the spring member having a spring that is positioned against a plug mounted in the bore at the outer rear side portion of the wrench body portion and that is positioned against a ball at the other end of the spring, whereby the ball partially protrudes form the bore into the recess and presses against the pawl to hold the pawl in the desired tightening or loosening position, the plug having an oil cap permitting oil to be added to lubricate the pawl holding means.

* * * * *